US009264792B2

(12) United States Patent
Mainini et al.

(10) Patent No.: US 9,264,792 B2
(45) Date of Patent: Feb. 16, 2016

(54) EAR TIP WITH STABILIZER

(71) Applicant: Plantronics, Inc., Santa Cruz, CA (US)

(72) Inventors: Matthew J Mainini, Santa Cruz, CA (US); Jacob T Meyberg, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 14/181,519

(22) Filed: Feb. 14, 2014

(65) Prior Publication Data

US 2015/0071477 A1 Mar. 12, 2015

Related U.S. Application Data

(63) Continuation-in-part of application No. 29/466,393, filed on Sep. 6, 2013, now Pat. No. Des. 717,771.

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01); *H04R 1/1066* (2013.01); *H04R 25/658* (2013.01); *H04R 2201/107* (2013.01); *H04R 2225/025* (2013.01)

(58) Field of Classification Search
CPC .... H04R 1/1016; H04R 1/105; H04R 1/1066; H04R 25/64; H04R 25/658; H04R 2201/10; H04R 2201/105; H04R 2201/109; H04R 2225/025; H04R 2420/07; H04R 2201/107
USPC ..... 381/322, 326, 328, 370, 374, 376, 380; 181/128, 129, 130, 135; 379/430, 379/433.01; 128/864, 866
See application file for complete search history.

(56) References Cited

U.S. PATENT DOCUMENTS

| | | | | |
|---|---|---|---|---|
| 1,953,437 | A * | 4/1934 | Schier | 181/135 |
| 5,712,453 | A | 1/1998 | Bungardt et al. | |
| 7,536,008 | B2 * | 5/2009 | Howes et al. | 379/433.01 |
| D628,188 | S | 11/2010 | Koch | |
| D681,602 | S | 5/2013 | Koch et al. | |
| D699,215 | S | 2/2014 | Koch et al. | |
| 2002/0131585 | A1 * | 9/2002 | Jones et al. | 379/431 |
| 2014/0286515 | A1 * | 9/2014 | Bone et al. | 381/328 |

* cited by examiner

*Primary Examiner* — Huyen D Le
(74) *Attorney, Agent, or Firm* — Chuang Intellectual Property Law

(57) ABSTRACT

Methods and apparatuses for delivering sound to a user ear are disclosed. In one example, an apparatus for delivering sound to an ear canal includes a body dimensioned to fit in a cavum concha area of a user ear, and a stabilizer member extending from the body arranged to bypass contact with a crus helix and contact a concha area of the user ear.

10 Claims, 8 Drawing Sheets

EAR TIP WITH STABILIZER

CROSS-REFERENCE TO RELATED APPLICATION

This application is a continuation-in-part application of co-pending U.S. Design patent application Ser. No. 29/466,393, filed Sep. 6, 2013, the disclosure of which is incorporated herein by reference in its entirety.

BACKGROUND OF THE INVENTION

Various audio products exist in which a receiver is placed in the user's ear. For example, "in-the-ear" headsets or headphones, also referred to as ear bud or concha style headsets or headphones are devices for transmitting received sounds to the ear of the user by means of a small receiver which is sized to fit in the cavum concha in front of the ear canal. Conventional ear bud concha style headsets position the receiver inside the cavum concha between the tragus and anti-tragus to establish placement and support on the ear.

However, most audio products that are intended to be worn in the ear tend to be unstable or uncomfortable when worn. Different ear shapes and sizes make it difficult for a single design to fit the ear correctly, stabilize the headset, and be comfortable for the user. Minor size and shape variations of the concha of individual users results in instability for users whose concha do not hold the headset with sufficient force or discomfort to those with smaller concha. Accordingly, the receiver is typically designed for a minimally sized concha and then held in place by an external mechanical stabilizer device such as a headband which arches over the top of the head or an ear hook which fits around the outside of the ear.

External mechanical stabilizer devices add complexity, which decreases ease of use and increases the cost of manufacturing. Some mechanical stabilizers can be difficult to operate or wear on the ear correctly due to an unintuitive or poor design, and require manual adjustment to position the receiver. Mechanical stabilizers also increase the size and weight of the headset, resulting in increased fatigue from prolonged use.

Furthermore, such external mechanical stabilizers may not properly position the receiver in the ear, thereby allowing audio to "leak" out from the user ear. This results in poor listening sound quality. The mechanical stabilizer may not ensure that the receiver stays in front of the ear canal, requiring the user to periodically readjust the stabilizer or receiver during usage to correct the placement.

As a result, there is a need for improved methods and apparatuses for wearing audio products.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Methods and apparatuses for delivering sound to a user's ear are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments.

Generally, this description describes a method and apparatus for an ear tip (also referred to as an "eartip" or "earbud") having a stabilizer for use with an audio device such as a headset or stereo headphones or stereo ear buds. The ear tip is conformable to the user's outer ear when inserted, and provides an acoustic seal when inserted. The ear tip is self adjusting, and can be fitted to various ear cavum sizes for comfortable wearing and a secure fit. The present invention is applicable to a variety of different types of mobile communication devices in addition to communication headsets, including stereo listening headsets and any other devices designed to deliver sound to the ear canal. While the present invention is not necessarily limited to such devices, various aspects of the invention may be appreciated through a discussion of various examples using this context.

Figure 7A:
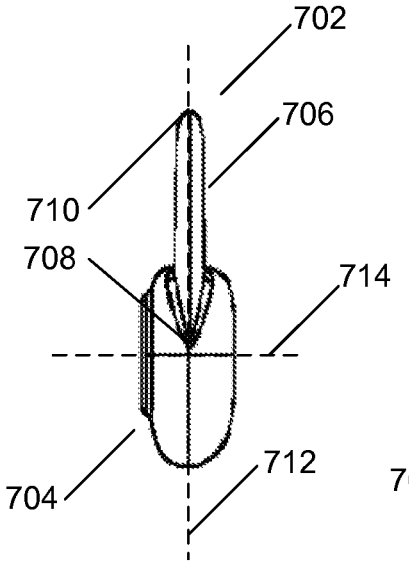
FIG. 7A (Prior Art)
FIG. 7A illustrates a side view of a prior art ear tip.
Figure 7B:
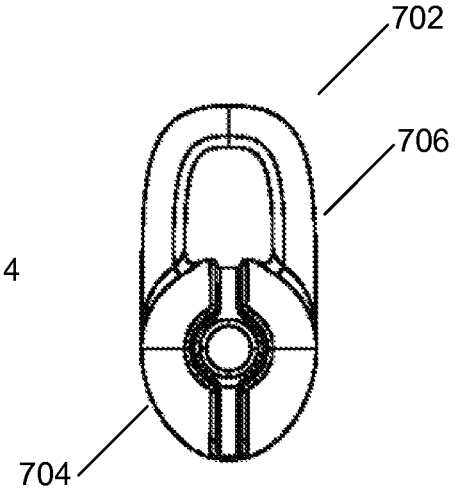
FIG. 7B (Prior Art)
FIG. 7B illustrates a front view of the prior art ear tip shown in FIG. 7A.

FIG. 7A illustrates a side view of a prior art ear tip 702. FIG. 7B illustrates a front view of the prior art ear tip 702 shown in FIG. 7A. Prior art ear tip 702 includes a body 704 and a tail 706. Tail 706 is substantially rectangular. Body 704 has a major axis 712 and a minor axis 714, where the length of the major axis 712 is greater than a length of the minor axis 714. The major axis 712 is along a diameter of the body 704 extending through the center of the body 704 and the minor axis 14 along the height of the body 704. First end 708 of tail 706 is attached to the body 704 at a location on the major axis 712. The second end 710 of tail 706 terminates at a location along the major axis 712 extending through the center of the body 704. The inventors have recognized that the prior art ear tip 702 is flawed.

In particular, the inventors have recognized the problem that the pinna anatomy, specifically the cavum and the crus helix, is very sensitive to pressure and prone to discomfort due to pressure from an ear tip. Even minimal pressure may cause discomfort. However, without an ear tip interface, the headset will not remain stable in the ear and is likely to fall out. Headset stability must be achieved, but comfort is affected by the prior art ear tip interface. Stability and comfort are often at odds, and one cannot usually improve one without negatively affecting the other.

In one example, the invention provides a solution to the stability/comfort issue of the prior art ear tip. A stabilizer tail is attached asymmetrically to an ear tip body. The stabilizer tail is attached asymmetrically to avoid a crus helix touch point, thus immediately increasing comfort for users who have a crus helix raised above the surface of the cavum floor. This also has the benefit of wedging the front of the ear tip interface body towards the ear canal opening more directly, positioning the front of the ear tip body better and pulling the boom slightly in the correct direction, towards the wearer face.

In one example, the ear tip is formed from materials having two different levels of hardness. For example, the main ear tip body has a hardness of approximately 60-shore A durometers and the stabilizer tail has a hardness of approximately 30-shore A durometers. This produces better stability and better comfort. If only a higher level hardness is used, as in the prior art, stability is high but the rigidity of the material negatively affects the comfort. If only a lower level hardness is used, the ear tip is likely to tear. The blend of both durometer levels at the specific junction allows for the strength and stability needed, while allowing flexibility exactly where it is needed (i.e., in the tail) to increase comfort, without losing stability.

In one example, three sizes of ear tips may be utilized to accommodate small, medium, and large cavum ears. These sizes may be determined by testing and evaluating multiple sizes of ear tips on test participants until the proper sizes are determined to provide the optimal fit for the respective ear shapes and sizes.

Advantageously, the user will benefit tremendously from wearing the inventive ear tip over the prior art ear tip designs. The inventive ear tip improves comfort significantly, while retaining the same level or better stability of the previous ear tip designs. The comfort gains allow the user to wear headsets for longer periods of time, which translates to more positive user experiences, longer wearing to allow for contextual intelligence applications, and longer phone call or music/entertainment listening.

In one example, an apparatus for delivering sound to an ear canal includes a body having a major axis and a minor axis, a length of the major axis greater than a length of the minor axis. The major axis is along a diameter of the body and the minor axis along the height of the body. The apparatus includes a flexible tail extending from the body. The flexible tail includes a first end attached to the body at a location offset from the major axis extending through a center of the body, and a second end to contact a user ear.

In one example, an apparatus for delivering sound to an ear canal includes a body dimensioned to fit in a cavum concha (also referred to as the "lower concha") area of a user ear, and an offset stabilizer member extending from the body arranged to bypass contact with a crus helix and contact a concha area of the user ear.

In one example, a method for delivering sound to an ear canal utilizes an ear tip having a body and a stabilizer member extending from the body. The method includes inserting the body into a user ear, and inserting the stabilizer member into the user ear comprising bypassing contact with a crus helix and contacting a cymba concha (also referred to as the "upper concha") area of the user ear upon completion of insertion.

Figure 1A:
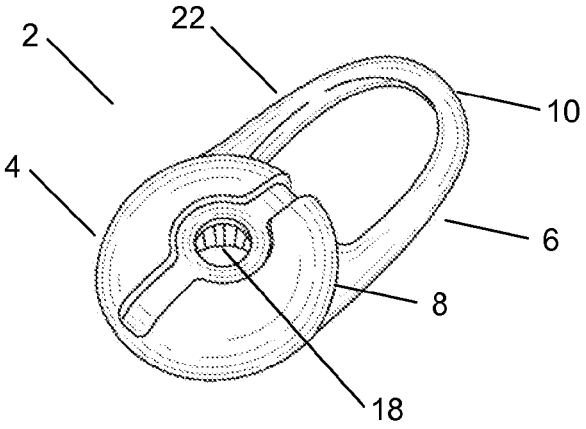
FIG. 1A illustrates a perspective view of an ear tip in an example of the invention.
Figure 1B:
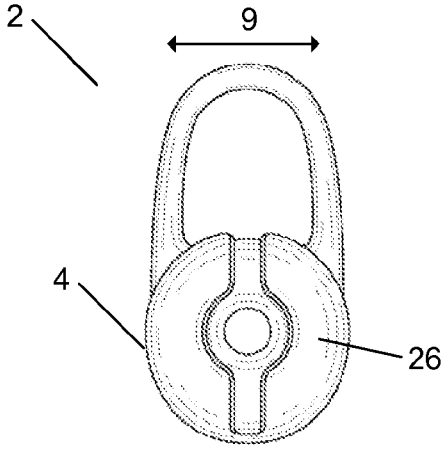
FIG. 1B illustrates a front view of the ear tip shown in FIG. 1A.
Figure 1C:
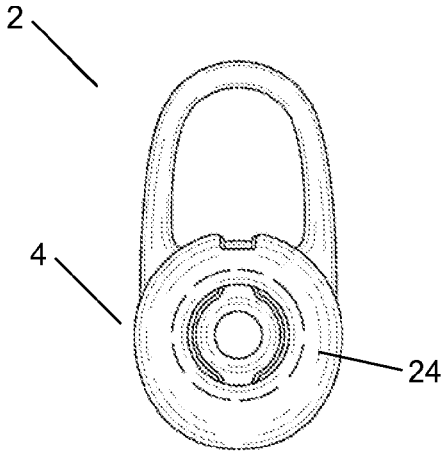
FIG. 1C illustrates a back view of the ear tip shown in FIG. 1A.
Figure 1D:
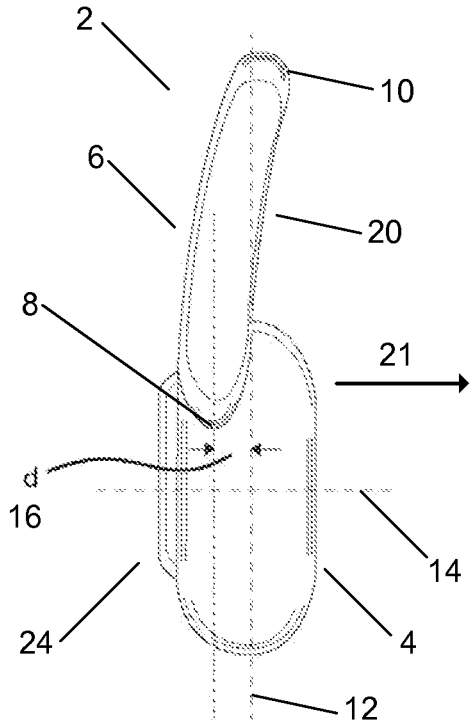
FIG. 1D illustrates a right side view of the ear tip shown in FIG. 1A.
Figure 1E:
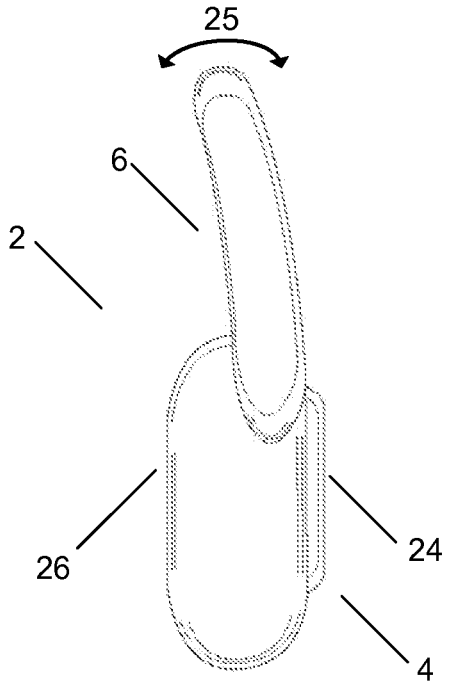
FIG. 1E illustrates a left side view of the ear tip shown in FIG. 1A.
Figure 1F:
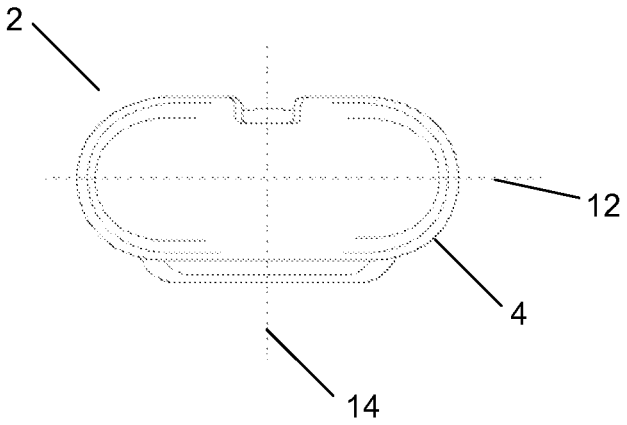
FIG. 1F illustrates a bottom view of the ear tip shown in FIG. 1A.
Figure 1G:
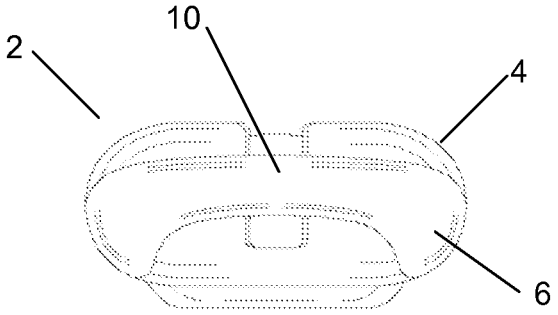
FIG. 1G illustrates a top view of the ear tip shown in FIG. 1A.

FIG. 1A illustrates a perspective view of an ear tip 2 for delivering sound to an ear canal in an example of the invention. FIGS. 1B and 1C respectively illustrate a front view and back view of the ear tip 2. FIGS. 1D and 1E respectively illustrate a right side view and left side view of the ear tip 2. FIGS. 1F and 1G respectively illustrates a bottom view and top view of the ear tip 2.

Referring to FIGS. 1A-1G, the ear tip 2 of the present invention includes two major sections, a body 4 and an appendage 6 (also referred to herein as a "tail" or "stabilizer member") extending from the body 4. The flexible tail 6 includes a first end 8 attached to the body 4 and a second end 10 to contact the user ear. In one example, the body 4 is substantially toroidal in shape as shown. Body 4 includes a centered aperture 18 serving as a port from first surface 24 to second surface 26. In one example, the body 4 is arranged to attach to a headset receiver. Aperture 18 may be adapted to receive a connector device (e.g., an interlocking hard plastic connector) during assembly for mating with an associated connector at a headset receiver in one example of the invention. In a further example of the invention, aperture 18 of ear tip 2 may mate directly with a headset receiver.

The flexible tail 6 includes an elliptical loop 22 having an open center. Referring to FIG. 1B, the elliptical shape of tail 6 allows for greater flex along a direction 9 in the plane of the first surface 24 and second surface 26 in comparison to a square or rectangular shaped tail. Referring to FIG. 1E, tail 6 also flexes in a direction 25 towards and away from first surface 24 and second surface 26. Advantageously, the flexibility of tail 6 in multiple directions allows for positioning and conforming of the tail 6 to specific user ears, providing enhanced stability of a headset. In one example, the distance from the center point to the tail is approximately 17 mm to 21 mm and the overall length of the eartip is approximately 25 mm-30 mm. In one example, at least a portion of the flexible tail 6 is formed from a material having a different hardness than a body 4 material.

Body 4 is dimensioned to fit in a cavum concha area of a user ear, and flexible tail 6 is arranged to bypass contact with a crus helix and contact a cymba concha area of the user ear. Referring to FIG. 1D, body 4 has a major axis 12 and a minor axis 14, where the length of the major axis 12 is greater than a length of the minor axis 14. The major axis 12 is along a diameter of the body 4 extending through the center of the body 4 and the minor axis 14 along the height of the body 4. In one example, the flexible tail 6 has a curvature 20. Curvature 20 is present to assist tail 6 to avoid contact with the crus helix. In a further example, tail 6 is straight. In certain examples, depending upon user preference and/or the variable size and shape of the user's ear, the positioning of tail 6 within the user ear may vary to achieve an optimal fit for a particular user. For example, tail 6 may be positioned at different locations within the concha, specifically the cavum and cymba area. The tail will be depressed at 10 and tail 6 will distribute the load along the surface of the cavum and/or cymba, depending on positioning. The surface friction combined with the specific pressure (due to durometer of tail) that forces the eartip body 4 towards the ear canal achieve the desired stability while maintaining high comfort.

First end 8 of flexible tail 6 is attached to the body 4 at a location offset from the major axis 12. For example, tail 6 is attached offset from major axis 12 a distance d 16 along minor axis 14 towards surface 24 (i.e., towards the headset receiver). For example, distance d 16 is approximately 1.5 mm to 2.0 mm. In one example, the second end 10 terminates at a location along the major axis 12 extending through the center of the body 4.

Figure 3:
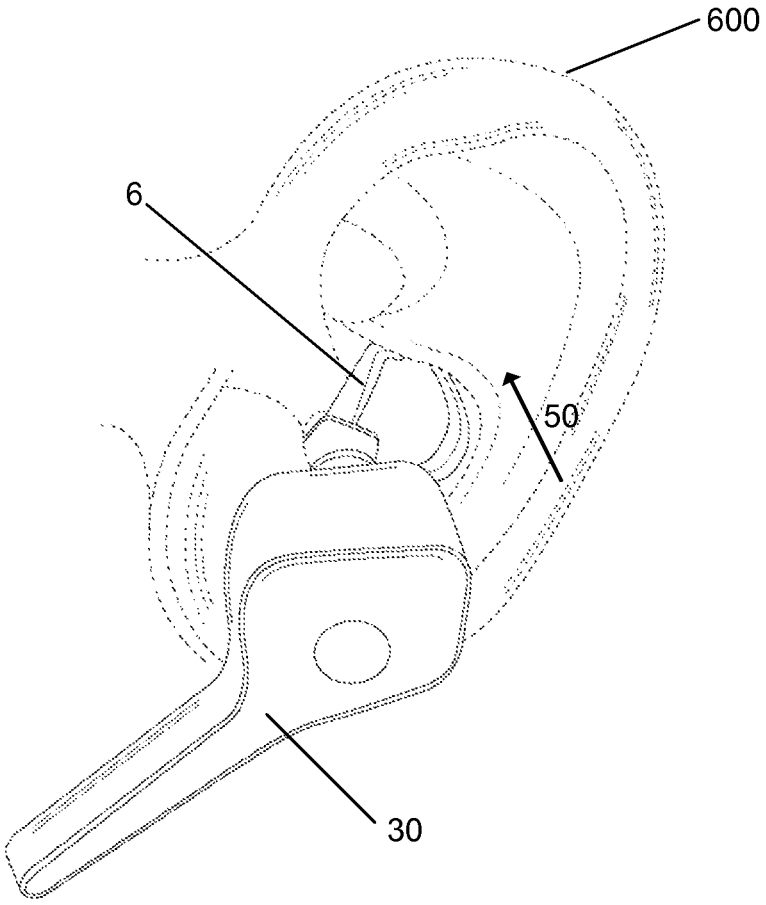
FIG. 3 illustrates an ear tip in one example of the present invention inserted within a human ear.

Positioning of the first end 8 of the flexible tail 6 to the body 4 at a location offset from the major axis 12 provides several advantages. This position allows flexible tail 6 to minimize or avoid contact with the crus helix of the user ear, which is particularly sensitive to contact. As such, user comfort is increased. Referring to FIG. 3, this position also advantageously allows insertion of the flexible tail 6 at an increased angle in a direction 50 wedging into the user's cavum or cymba concha greater than prior art devices.

Furthermore, this position allows body 4 to be inserted into the user ear in direction 21 shown in FIG. 1D to a greater extent and more securely than the prior art ear tip 702 shown in FIG. 7A because the first end 8 of tail 6 does not interfere with almost full insertion of body 4. As such, stability of the ear tip 2, and therefore an attached headset (or stereo/audio ear buds) worn by the user, is also improved.

Referring again to FIG. 1D and FIG. 3, curvature 20 of tail 6 advantageously enhances insertion of the flexible tail 6 at an increased angle in direction 50 into the users cymba or cavum concha greater than prior art devices, thereby working together with the offset positioning of the first end 8 of the flexible tail 6 on the body 4 to provide enhanced stability (i.e., a more secure fit).

In one example, first surface 24 is arranged to attach to a headset receiver and second surface 26 contacts a user ear. The tail 6 is attached to the body 4 at a location closer to the first surface 24 than the second surface 26 to bypass contact with the crus helix and allow greater insertion of body 4 into the cavum concha. For example, the stabilizer tail 6 is attached to the body 4 at a location between the first surface 24 and a plane parallel to the first surface 24, the plane located at a midpoint between the first surface 24 and the second surface 26.

In one example, the body 4 is compressible and resilient. The compressibility of the body 4 accommodates variations in concha and ear size and ensures adequate holding pressure within the concha after placement in the user ear. The ear tip 2 is interchangeable with other ear tips of varying sizes to accommodate individual variations in user concha and ear size as well as user preference. For example, ear tip 2 may come in small, medium, and large sizes ranging in diameter from approximately 11-17 mm and height from 6-8 mm.

To achieve the compression characteristics of the ear tip 2 herein described, the body 4 and the flexible tail 6 are composed of a soft, elastic or elastomeric material. In one example, the material selected is non-porous. For example, ear tip 2 may be constructed from a compressible, conformable, and resilient material. Suitable materials include elastomers, foam, and air-filled injection molded materials. The elastomer may be sponge-like, filled with air pockets to enhance compressibility. The body 4 may also be hollow in a further example of the invention. Ear tip 2 may be fabricated by a variety of conventional methods including casting, overmolding, compression molding, and injection molding. In operation, the body 4 is inserted into a cavum concha area of a user ear. The tail 6 bypasses contact with a crus helix and contacting a cymba concha area of the user ear upon completion of insertion.

Figure 2A:
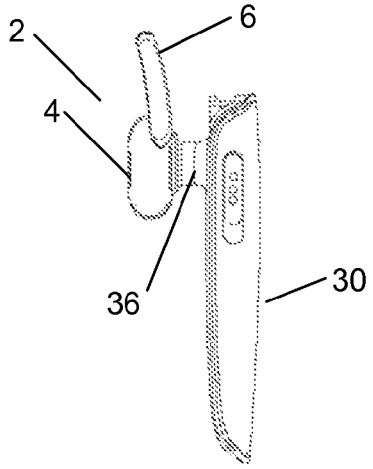
FIG. 2A illustrates a first side view of the headset and ear tip shown in FIG. 2A.
Figure 2B:
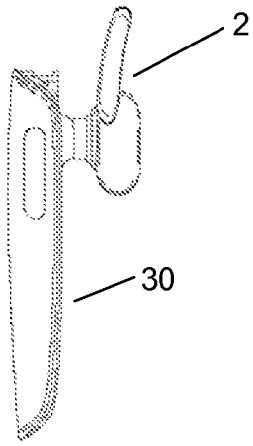
FIG. 2B illustrates a second side view of the headset and ear tip shown in FIG. 2A.
Figure 2C:
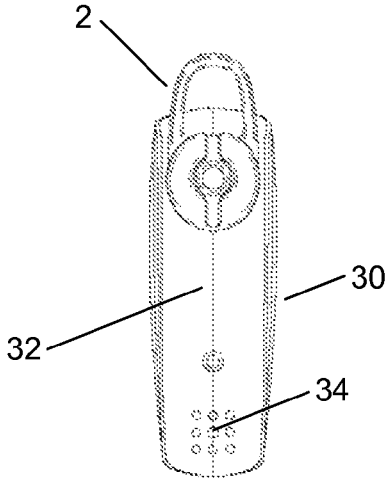
FIG. 2C illustrates a top view of an inner side of a headset and an ear tip in one example.

FIG. 2C illustrates a top view of an inner side 32 of a headset 30 and an ear tip 2 in one example. FIGS. 2A and 2B respectively illustrates a first side view and a second side view of the headset 30 and ear tip 2 shown in FIG. 2C. Referring to FIG. 2A, the body 4 of ear tip 2 is arranged to attach to a headset (or audio ear buds) receiver 36. For example, a connector formed from a plastic, elastomer, or metal material may be assembled within the body 4. The connector may be constructed from a rigid plastic, elastomer, or metal material to which ear tip 2 is overmolded. In one mode of operation, the connector is designed to interlock with an associated connector at the headset receiver 36 for either left or right ear wearing. Alternatively, the ear tip 2 may attach to the headset receiver 36 directly. The ear tip 2 delivers audio and secures and stabilizes the headset body as described herein.

Figure 6:
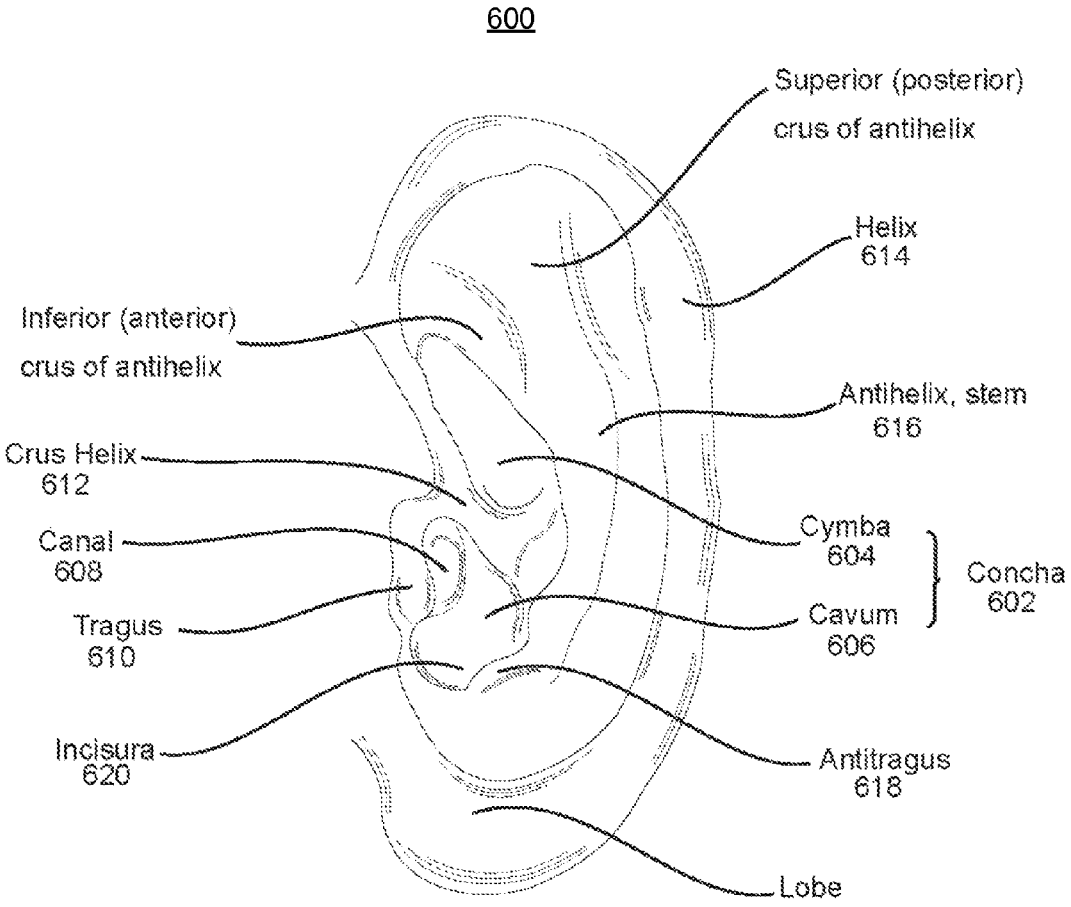
FIG. 6 illustrates a human ear.

FIG. 3 illustrates an ear tip 2 in one example of the present invention inserted within a human ear 600. Referring to FIG. 3 and FIG. 6 together, in operation, the user pushes body 4 into the cavum concha 606 where it rests in the user ear. Tail 6 is inserted into the user ear and bypasses contact with a crus helix 612, contacting a cymba concha 604 area of the user ear. In one example, tail 6 engages the cymba concha 604 below the antihelix 616 when the headset receiver is placed in the cavum concha 606. Tail 6 is advantageously inserted at an increased angle in direction 50 into the user cymba concha 604.

The cavum concha 606 and incisura 620 define a wedge-shaped space with an apex pointing generally toward the chin. To provide improved stability, tail 6 engages the cymba concha 604 area while the body 4 rests within the cavum concha 606 of the ear 600. Tail 6 is elongated and flexible and automatically adjusts and conforms to the size and shape of the cymba concha 604 while providing sufficient force to hold the headset (or audio ear buds) receiver against the cavum concha 606. Tail 6 maintains the headset receiver in the cavum concha 606, ensuring proper placement and eliminating the need for frequent readjustment.

In certain examples, depending upon user preference and/or the variable size and shape of the user's ear, the positioning of tail 6 within the user ear may vary to achieve an optimal fit for a particular user. For example, tail 6 may be positioned at different locations within the concha 602, including at least some contact with the cavum concha 606.

Since the cavum concha 606 and incisura 620 define a wedge-shaped space, the toroidal shaped body 4 compresses as it is placed within the wedge shaped space. Upon release, the body 4 expands to fill the cavum concha 606, conforming to the individual user's cavum concha 606 to provide optimal acoustic coupling. Body 4 does not penetrate the ear canal 608. Because the shape of the cavum concha 606 is neither circular nor symmetrical from left to right ears, a toroidal shape in very soft, resilient and malleable material is advantageously selected for personalized custom fit and long term wearing comfort, allowing the ear tip 2 to deform and adapt to the shape of the concha, and thereby maintain the headset receiver firmly in position. In one example, several sizes of ear tips may be selected from to provide a more personalized fit.

Figure 4:
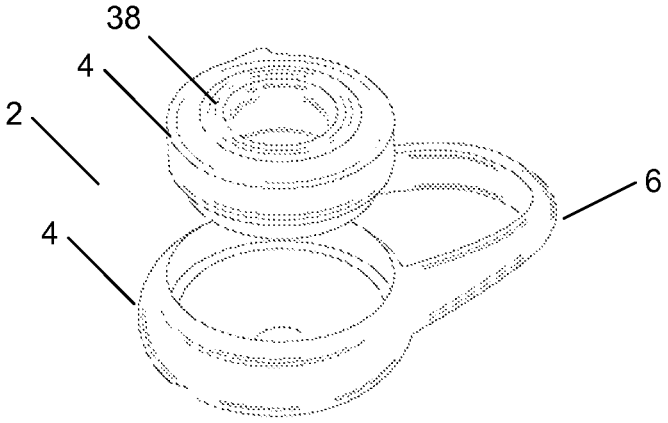
FIG. 4 illustrates an ear tip formed from a first material and a second material having different hardness in one example.

FIG. 4 illustrates an ear tip 2 formed from a first material and a second material having different hardness levels in one example. In the example shown in FIG. 4, the body 4 has a portion 38 formed from a material having a higher hardness level than tail 6. For example, portion 38 is formed from a material having a hardness of approximately 60-90 shore-A durometers and tail 6 is formed from an elastomer material having a hardness of approximately 30-40 shore-A durometers. Portion 38 advantageously has a greater hardness so that it can be attached to the headset receiver in a secure manner (i.e., it does not tear or unintentionally decouple or spin about the receiver). Tail 6 advantageously has a lower hardness so that it can flex as desired to more easily conform to the user ear in a wedge like manner when inserted to provide a sufficient friction to hold the headset receiver in place. The lower hardness of tail 6 further promotes comfort to the user.

Figure 5:
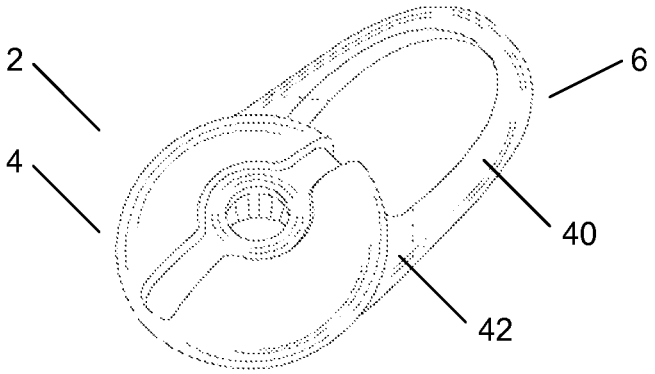
FIG. 5 illustrates an ear tip formed from a first material and a second material having different hardness in a further example.

FIG. 5 illustrates an ear tip 2 formed from a first material and a second material having different hardness levels in a further example. In the example shown in FIG. 5, at least a portion 40 of the flexible tail 6 is formed from a material having a lower hardness level than a body 4 material. For example, portion 40 of tail 6 is formed from an elastomer material having a hardness of approximately 30-40 shore-A durometers and the remaining portion 42 of tail 6 and body 4 are formed from a material having a hardness of approximately 60-90 shore-A durometers.

FIG. 6 illustrates a human ear 600. The outer ear, or pinna, is an irregularly concave cartilaginous member comprised of a number of eminences and depressions which give each ear a distinct shape and form. The helix 614 is the curved outer rim of the ear; below the helix 614 is the anti-helix 616, a curved prominence which describes a curve around the concha 602, a deep cavity containing the entry to the ear canal 608. The concha 602 is divided into two parts, the cymba concha 604 and cavum concha 606, by the crus helix 614 which curves around the outside of the ear, and extends inwards at about the vertical midpoint of the ear. The cymba concha 604 lies above the crus helix 614 and below the anti-helix 616; the cavum concha 606 lies below the crus helix 614 and surrounds the entry to the ear canal 608. In front of the cavum concha 606 and projecting backwards from the front of the ear is the tragus 610, a small semicircular prominence. Opposite the tragus 610 and separated from it by the deep curvature of the incisura 620 is the antitragus 618.

The various examples described above are provided by way of illustration only and should not be construed to limit the invention. The invention can be used with any concha style headset receiver coupled to any audio source. The ear tip can be used with any headset for personal listening to any audio source device. For example, the invention can be used with headsets or headphones/stereo ear buds typically employed for listening to music or video entertainment. Although use of a toroidal shaped section is described, other similar shapes such as discs, "tire" shaped sections, or other flattened spherical shapes are considered equivalent.

Based on the above discussion and illustrations, those skilled in the art will readily recognize that various modifications and changes may be made to the present invention without strictly following the exemplary embodiments and applications illustrated and described herein. Such changes may include, but are not necessarily limited to: size of the ear tip and associated sections, material of the ear tip, and mating mechanism with an audio device receiver. Furthermore, the shapes and sizes of the illustrated headset housing and components may be altered. Such modifications and changes do not depart from the true spirit and scope of the present invention that is set forth in the following claims.

Thus, the scope of the invention is intended to be defined only in terms of the following claims as may be amended, with each claim being expressly incorporated into this Description of Specific Embodiments as an embodiment of the invention.

What is claimed is:

1. An apparatus for delivering sound to an ear canal comprising:

a body dimensioned to fit in a cavum concha area of a user ear, the body having a first surface to attach to a headset receiver and a second surface to contact a user ear; and a stabilizer member irremovably attached to the body at a location closer to the first surface than the second surface, the stabilizer member having at least a portion formed from a material having a lower hardness than a body material, the stabilizer member arranged to extend from the body to bypass contact with a crus helix and contact a concha area of the user ear.

2. The apparatus of claim 1, wherein the body has a diameter of approximately 11-17 mm and a height of approximately 6-8 mm.

3. The apparatus of claim 1, wherein the body comprises an aperture.

4. The apparatus of claim 1, wherein the at least a portion of the stabilizer member comprises an elastomer material having a hardness of approximately 30-40 shore-A durometers and the body material comprises a hardness of approximately 60-90 shore-A durometers.

5. The apparatus of claim 1, wherein the concha area comprises a cymba concha.

6. The apparatus of claim 1, wherein the stabilizer is attached to the body at a location between the first surface and a plane parallel to the first surface, the plane located at a midpoint between the first surface and the second surface.

7. The apparatus of claim 1, wherein the stabilizer member comprises an elliptical loop.

8. The apparatus of claim 1, wherein the stabilizer member has a curvature.

9. A method comprising:

inserting an ear tip body into a user ear, the ear tip body having a first surface to attach to a headset receiver and a second surface to contact a user ear, the second surface contacting the user ear following insertion; and inserting an ear tip stabilizer member into the user ear comprising bypassing contact with a crus helix and contacting a cymba concha area of the user ear, the ear tip stabilizer member irremovably attached to the ear tip body at a location closer to the first surface than the second surface and having at least a portion formed from a material having a lower hardness than an ear tip body material.

10. The method of claim 9, wherein the ear tip body comprises a first surface to attach to the headset receiver and a second surface to contact a user ear, wherein the ear tip stabilizer member is attached to the ear tip body at a location between the first surface and a plane parallel to the first surface, the plane located at a midpoint between the first surface and the second surface.

* * * * *